US007314006B1

(12) United States Patent
Georgantzis et al.

(10) Patent No.: US 7,314,006 B1
(45) Date of Patent: Jan. 1, 2008

(54) NONLETHAL CANISTER TANK ROUND

(75) Inventors: Peter Georgantzis, East Stroudsburg, PA (US); Hugh D. MacMillan, Stanhope, NJ (US); Brian A. Levine, Jersey City, NJ (US); Henry E. Hudgins, Lords Valley, PA (US)

(73) Assignee: United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 11/162,678

(22) Filed: Sep. 19, 2005

Related U.S. Application Data

(60) Provisional application No. 60/522,431, filed on Sep. 30, 2004.

(51) Int. Cl.
*F42B 8/12* (2006.01)
*F42B 8/16* (2006.01)
*F42B 30/08* (2006.01)

(52) U.S. Cl. ..... 102/498; 102/502; 102/517

(58) Field of Classification Search ..... 102/431, 102/432, 455, 489, 498, 515–517, 520, 529, 102/502

See application file for complete search history.

(56) References Cited

U.S. PATENT DOCUMENTS

| | | | | | |
|---|---|---|---|---|---|
| 2,457,817 | A * | 1/1949 | Harrell | 102/389 |
| 2,983,224 | A * | 5/1961 | Prosen et al. | 102/522 |
| 3,262,390 | A * | 7/1966 | Cowles et al. | 102/458 |
| 3,446,147 | A * | 5/1969 | Burri et al. | 102/522 |
| 3,802,345 | A * | 4/1974 | La Costa | 42/78 |
| 3,935,816 | A * | 2/1976 | Boquette, Jr. | 102/444 |
| 3,951,068 | A * | 4/1976 | Schroeder | 102/364 |
| 3,991,682 | A * | 11/1976 | Peak | 102/438 |
| 4,063,508 | A * | 12/1977 | Whiting | 102/393 |
| 4,089,267 | A * | 5/1978 | Mescall et al. | 102/491 |
| 4,365,558 | A * | 12/1982 | Lippler et al. | 102/431 |
| 4,455,942 | A * | 6/1984 | Murray et al. | 102/444 |
| 4,589,342 | A * | 5/1986 | Rousseau | 102/377 |
| 4,664,034 | A * | 5/1987 | Christian | 102/457 |
| 4,716,835 | A * | 1/1988 | Leemans | 102/529 |
| 4,882,996 | A * | 11/1989 | Bock et al. | 102/496 |
| 4,922,826 | A * | 5/1990 | Busch et al. | 102/489 |
| 4,973,965 | A * | 11/1990 | Ridge et al. | 342/11 |
| 5,014,624 | A * | 5/1991 | Baxter et al. | 102/503 |
| 5,038,684 | A * | 8/1991 | Petrovich | 102/515 |
| 5,105,744 | A * | 4/1992 | Petrovich | 102/515 |
| 5,796,031 | A * | 8/1998 | Sigler | 102/520 |
| 6,546,874 | B2 * | 4/2003 | Vasel et al. | 102/444 |
| 6,990,905 | B1 * | 1/2006 | Manole et al. | 102/513 |
| 2005/0066849 | A1 * | 3/2005 | Kapeles et al. | 102/517 |

* cited by examiner

*Primary Examiner*—Bret Hayes
(74) *Attorney, Agent, or Firm*—John F. Moran; Michael C. Sachs

(57) ABSTRACT

A nonlethal canister tank round comprising a cartridge having a combustible case and containing propellant; a canister projectile attached to the cartridge, the canister projectile being generally cylindrical, comprising high density polyurethane foam and including a body and a cap for closing an open end of the body, the body defining a payload space therein; and a payload disposed in the payload space, the payload comprising one of rubber balls, fin stabilized projectiles, an inert material and fillable fin stabilized projectiles.

4 Claims, 6 Drawing Sheets

NONLETHAL CANISTER TANK ROUND

CROSS-REFERENCE TO RELATED APPLICATIONS

This application claims the benefit under 35 USC 119(e) of U.S. provisional patent application 60/522,431 filed on Sep. 30, 2004, which application is hereby incorporated by reference.

STATEMENT OF GOVERNMENT INTEREST

The inventions described herein may be manufactured, used and licensed by or for the U.S. Government for U.S. Government purposes.

BACKGROUND OF THE INVENTION

The invention relates in general to ammunition for tanks and, in particular, to a nonlethal tank round.

Tanks are lethal weapons, one of the most lethal. In the current Iraq peacekeeping action in a MOUT (Military Operations in Urbanized Terrain) environment, the tank is sometimes not useful because of its overwhelming lethality. A tank round is needed that can be used for riot control, crowd dispersal and as an opposition force deterrent, without inflicting lethality or high collateral damage. With a nonlethal round, tanks can enter conflicts to control and disperse crowds and insurgents while minimizing the risks to U.S. soldiers. A nonlethal round allows the tank to provide a peacekeeping role. It can also be used as a low collateral damage alternative when engaging crowds/enemies adjacent to restricted structures in MOUT (schools, hospitals, religious buildings, etc.).

SUMMARY OF THE INVENTION

It is an object of the invention to provide a large caliber nonlethal round for a tank.

It is another object of the invention to provide a tank round that produces nonlethal effects from both its payload and its blast pressure.

Still another object of the invention is to provide a nonlethal round wherein the payload disperses quickly after exiting the gun muzzle.

One aspect of the invention is a nonlethal canister projectile for attachment to a tank round, comprising a generally cylindrical body having an open end; a cap for closing the open end of the body; the body and cap comprising high density polyurethane foam and defining a payload space therein; and a payload disposed in the payload space. The payload may comprise, for example, a plurality of balls, a plurality of fin stabilized projectiles, a plurality of fillable fin stabilized projectiles or inert material.

Another aspect of the invention is a nonlethal canister tank round, comprising a cartridge having a combustible case and containing propellant; a canister projectile attached to the cartridge, the canister projectile being generally cylindrical, comprising high density polyurethane foam and including a body and a cap for closing an open end of the body, the body defining a payload space therein; and a payload disposed in the payload space.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

The present invention is capable of controlling crowds and engaging enemy Infantry in urban terrain. The various embodiments of the tank round of the invention use a defeat mechanism comprising widely dispersed nonlethal payloads and/or blast overpressure effects capable of obtaining nonlethal ranges from 50 to 600 meters.

Figure 1:
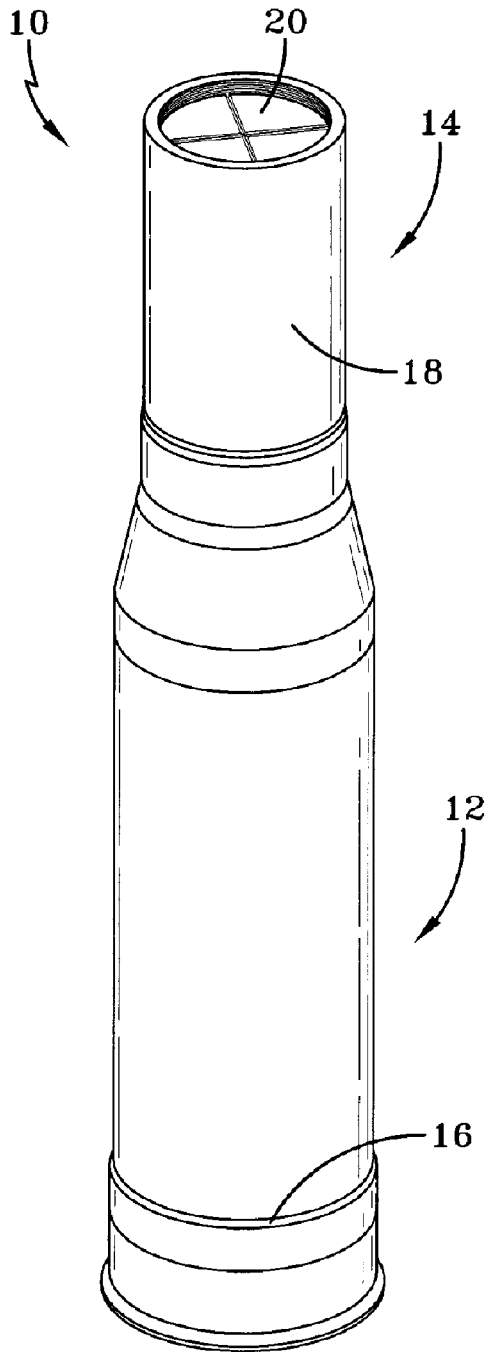
FIG. 1 is a perspective view of one embodiment of a nonlethal tank round.

FIG. 1 is a perspective view of one embodiment of a nonlethal tank round 10. Tank round 10 includes a standard tank cartridge 12 and a high-density polyurethane foam canister projectile 14. Projectile 14 includes a projectile body 18 and a projectile cap 20. Cartridge 12 is suitable for use in a 120 mm smooth bore tank gun. Cartridge 12 comprises, for example, JA2 propellant, a standard combustible cartridge case, an M125 cool primer and an obturator 16. Other suitable cartridges 12 may be used to enable firing of the tank round 10 from guns other than 120 mm tank guns.

Figure 2A:
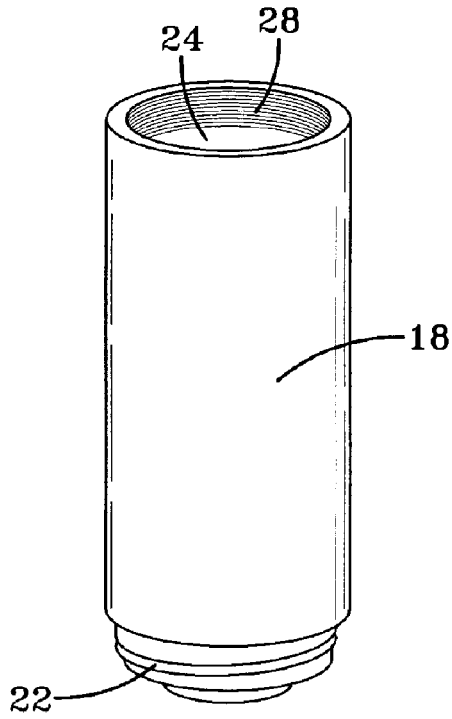
FIG. 2A is a perspective view of the body of a canister projectile.
Figure 2B:
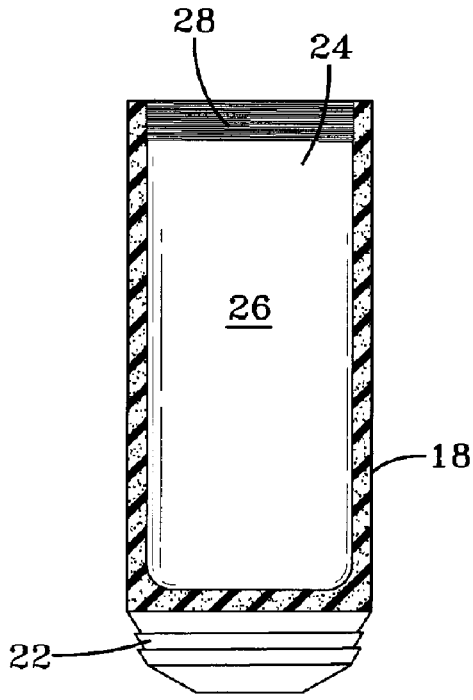
FIG. 2B is a side view, partially in section, of the body of FIG. 2A.
Figure 2C:
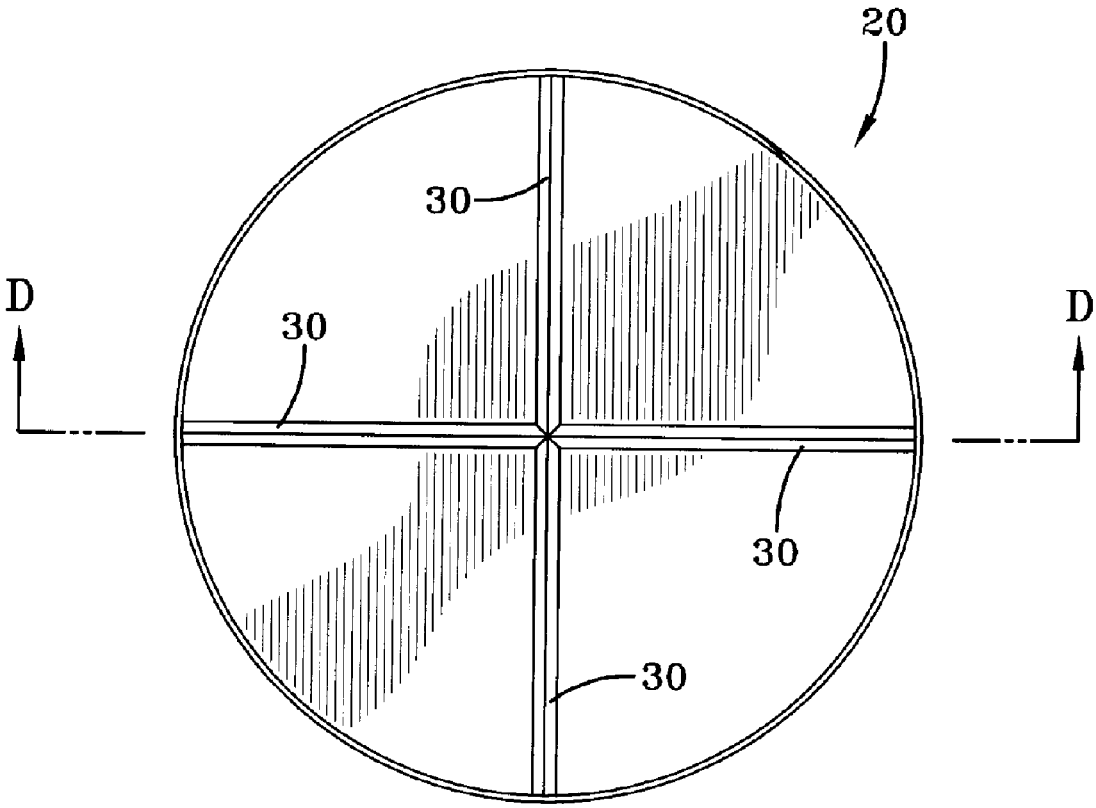
FIG. 2C is a top view of the cap.
Figure 2D:
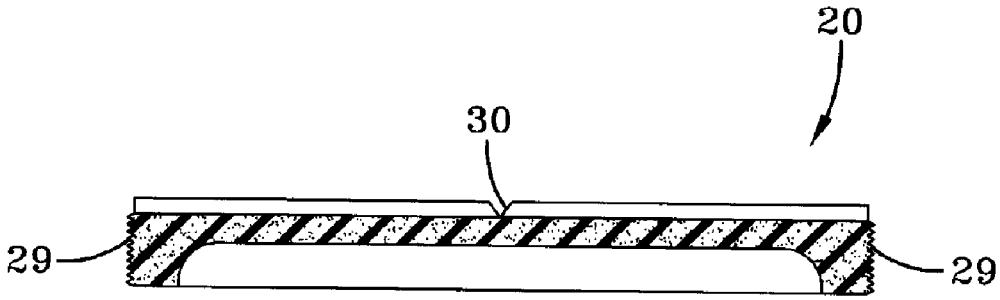
FIG. 2D is a sectional view of the cap taken along the line D-D of FIG. 2C.

FIG. 2A is a perspective view of the body 18 of the canister projectile 14. FIG. 2B is a side view, partially in section, of the body 18. FIG. 2C is a top view of the cap 20. FIG. 2D is a sectional view of the cap 20 taken along the line D-D of FIG. 2C. Referring to FIGS. 2A and 2B, body 18 includes an open end 24 that is closed by cap 20 and a threaded end 22 for attachment to cartridge 12. A payload space 26 is located inside body 18. Body 18 and cap 20 comprise, for example, high-density polyurethane foam. As shown in FIG. 2D, cap 20 includes external threads 29 for mating with internal threads 28 (FIG. 2B) on the interior of body 18 at open end 24. The top surface of cap 20 includes scoring, for example, four V-shaped grooves 30 spaced ninety degrees apart. The grooves 30 help the cap 20 disintegrate after exiting the gun muzzle.

Figure 3:
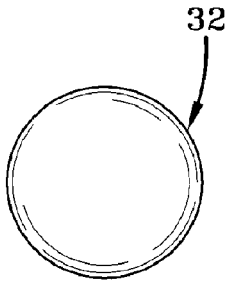
FIG. 3 is a perspective view of a sphere or ball.
Figure 4:
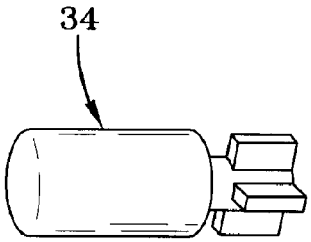
FIG. 4 is a perspective view of a fin-stabilized projectile.

The payload is disposed in payload space 26. The projectile payload may comprise a variety of different objects, for example, rubber balls, rubber rockets and fillable rockets capable of carrying irritants, malodorants, marking substances, etc. FIG. 3 shows a sphere or ball 32 made of, for example, a rubber-like material such as rubber or PVC. In a first embodiment, the payload comprises a plurality of balls 32, for example, about 440 balls having a diameter of about 0.6 inches. FIG. 4 shows a fin stabilized projectile 34 made of, for example, a rubber-like material, and having a length of about 1.75 inches and a width of about 0.75 inches. In a second embodiment, the payload comprises a plurality of fin-stabilized projectiles 34, for example, about 100 fin stabilized projectiles 34.

In a third embodiment of the invention, the payload space 26 of the canister projectile 14 is weighted with an inert material, such as sand or small pellets made of a rubber-like substance. In this embodiment, the projectile 14 functions much like a "blank" wherein the inert material falls to the ground shortly after muzzle exit and the nonlethal downrange effects are supplied by the blast overpressure.

Figure 5:
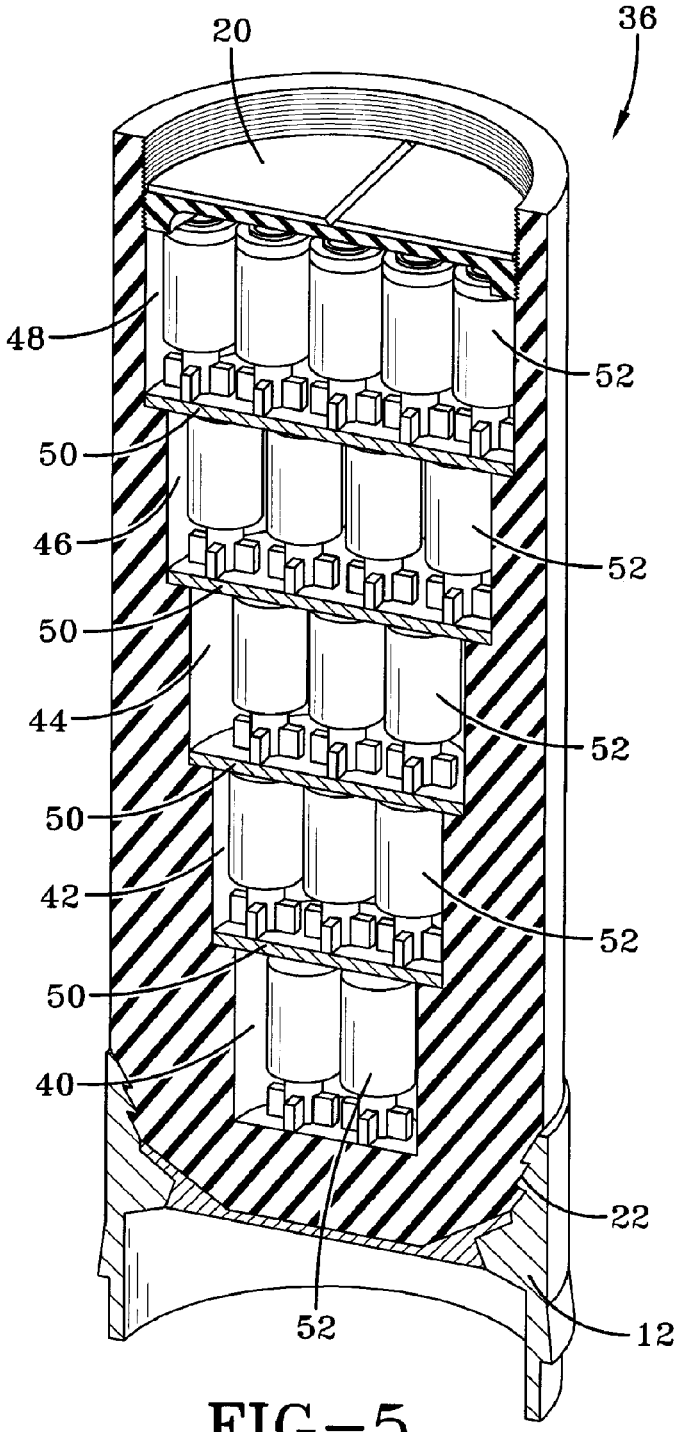
FIG. 5 is a cutaway view of a canister projectile.

FIG. 5 is a cutaway view of a fourth embodiment of a canister projectile 36. Projectile 36 includes a cap 20 and is attached to a cartridge 12 with, for example, threads 22, as in embodiments one to three. Projectile 36 is also made of, for example, high-density polyurethane foam. Projectile 36 differs from the first three embodiments in that its payload space 38 does not have a generally cylindrical shape, but comprises a plurality of subpayload spaces arranged in a stepped fashion. In FIG. 5, the number of subpayload spaces 40, 42, 44, 46, 48 is five and a partition 50 separates each subpayload space. The number of subpayload spaces in FIG. 5 is exemplary only, more or less could be used. As shown in FIG. 5, the subpayload spaces 40-48 increase in size toward the cap 20 of the projectile 36, thereby producing a stepped design. The stepped design reduces the set back forces on the filled fin stabilized projectiles 52, which comprise the payload of projectile 36.

Figure 6:
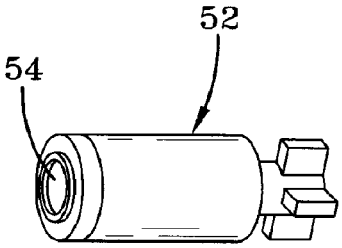
FIG. 6 is a perspective view of a fillable fin stabilized projectile.

FIG. 6 is a perspective view of a fillable fin stabilized projectile 52 having a removable cap 54. An exemplary size of projectile 52 is about 1.75 inches long and 0.75 inches wide. The projectiles 52 may be filled with, for example, marking substances, irritants, malodorants, etc. A plurality of the projectiles 52, for example, about sixty-two, comprise the payload of projectile 36, as shown in FIG. 5.

In each of the described embodiments, the foam projectile disintegrates when it exits the muzzle of the gun. In the case of the first, second and fourth embodiments, this disintegration allows the nonlethal payload to spread out in a circular pattern as it moves downrange. In the third embodiment where the projectile is essentially a blank round, the projectile disintegrates and the inert payload falls to the ground, but the nonlethal blast overpressure moves downrange. It should be noted that the first, second and fourth embodiments also have a blast overpressure that provides nonlethal effectiveness.

The four embodiments (rubber balls 32, rubber fin stabilized projectiles 34, fillable rubber fin stabilized projectiles 52, and inert or blank payload) were tested at Aberdeen Proving Ground in December of 2004. The first part of the tests obtained velocity data to develop drag curves for the various payloads and, in addition, determined the blast overpressure effects, flight follower data and cannon pressures for each embodiment. The second part of the tests obtained target data. The tests of the first, second and third embodiments (balls 32, projectiles 34 and inert payload) were successful. The test of the fourth embodiment was inconclusive.

Figure 7:
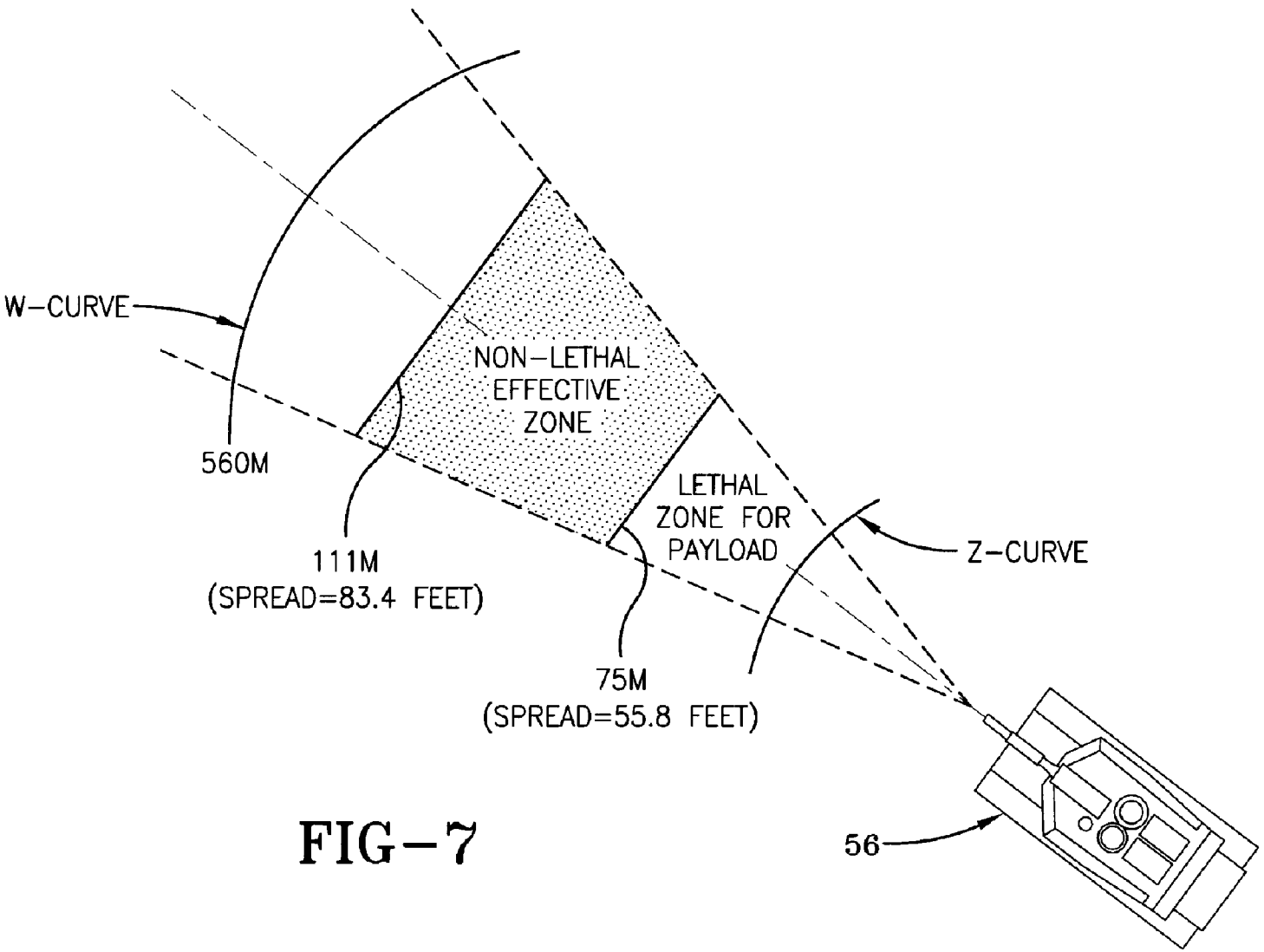
FIGS. 7, 8 and 9 illustrate the spread of the payloads, lethal ranges for payloads and blast overpressure, and nonlethal ranges for payloads and blast overpressures.
Figure 8:
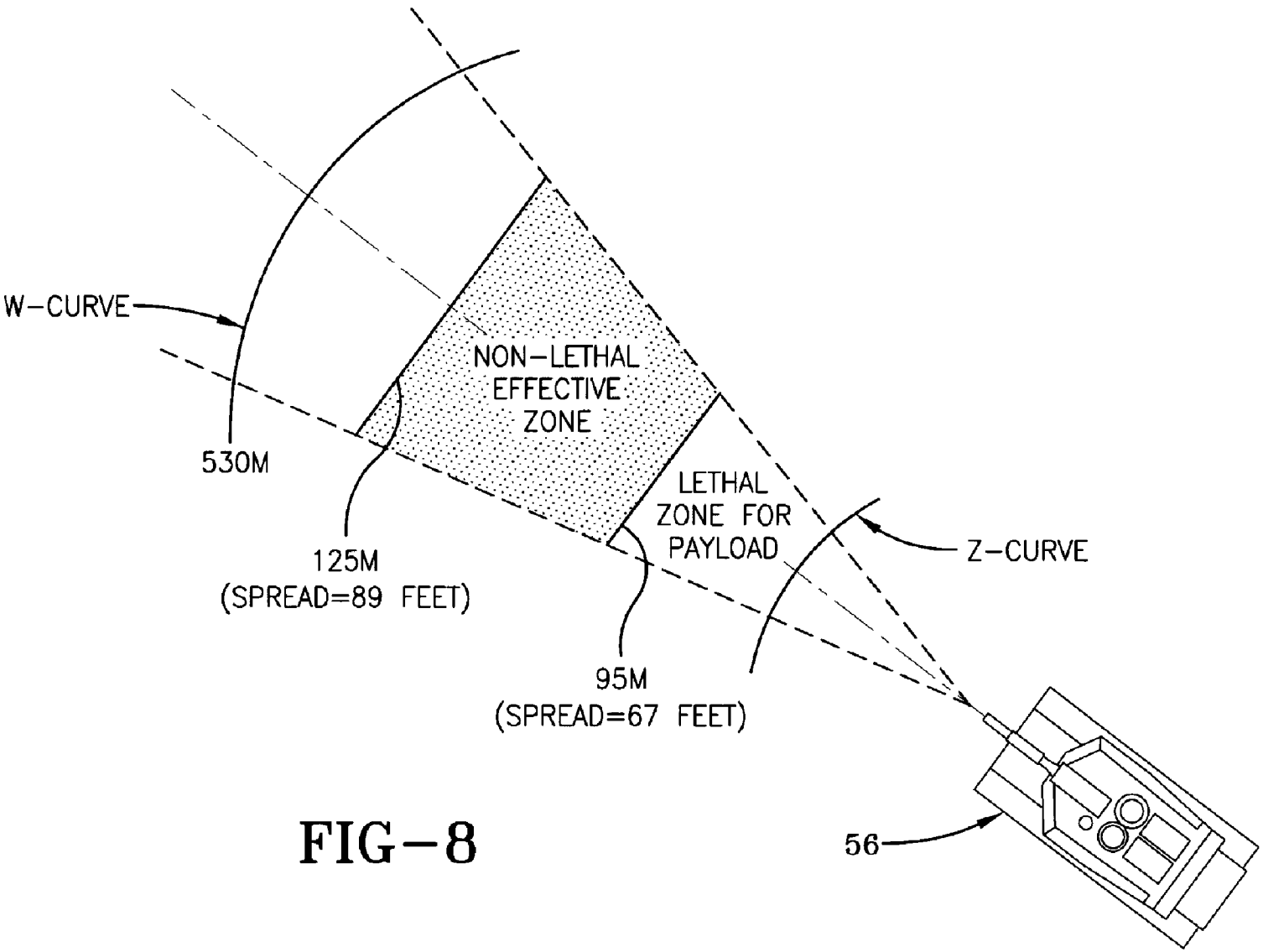
Figure 9:
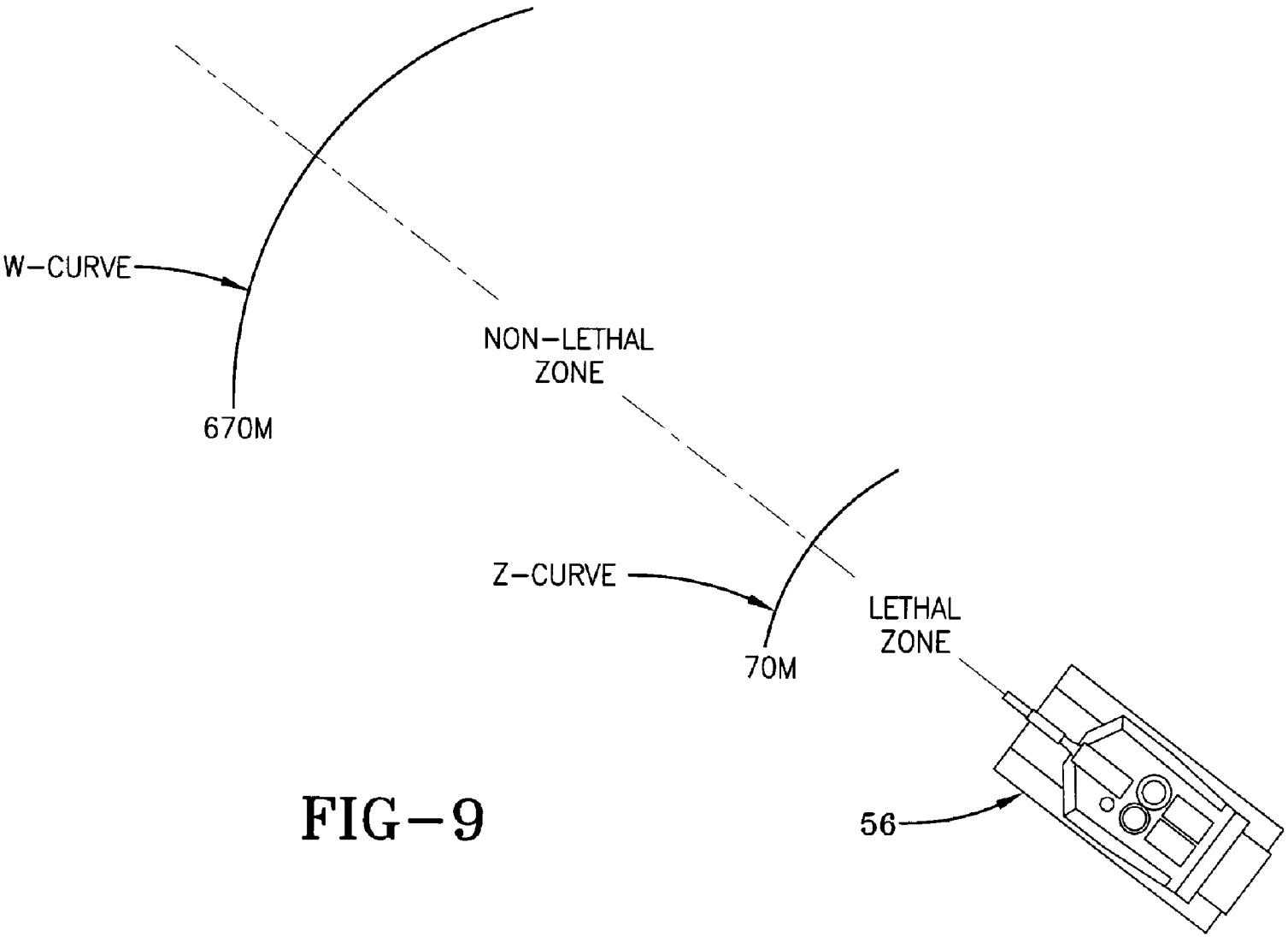

The target, velocity and pressure data were processed to determine the spread of the payload vs. range and the lethal and nonlethal effective ranges of the payloads and blast overpressure. FIGS. 7, 8 and 9 illustrate the spread of the payloads, lethal ranges for payloads and blast overpressure, and nonlethal ranges for payloads and blast overpressures. FIG. 7 is for a payload of 440 PVC balls 32 of 0.6 inch diameter. FIG. 8 is for 100 fin stabilized rubber projectiles 34. FIG. 9 is for the inert payload or "blank" embodiment.

Tank 56 is shown in the lower right corner of each figure. The lethal zone for blast overpressure extends from the tank 56 to the Z-curve. In the lethal zone of blast overpressure, injuries more severe than hearing loss can occur. Between the Z-curve and the W-curve is the effective nonlethal area of the blast overpressure. In the effective nonlethal area, the blast overpressure may cause temporary hearing loss and psychological effects. Beyond the W-curve, no hearing protection is required. Range distances are shown in meters. In FIG. 7 for the PVC balls 32, the blast overpressure is nonlethal effective out to 560 meters. In FIG. 8 for the fin stabilized rubber projectiles 34, the blast overpressure is effective out to 530 meters. In FIG. 9 for the inert payload, the blast overpressure is effective out to 670 meters.

Individuals experience a stinging sensation when hit with a payload. The nonlethal range of payloads is defined by the velocity of the payload. The nonlethal velocity range is from a velocity just slow enough to not pierce human skin to a velocity that is fifty percent of the velocity just slow enough to not pierce human skin. In FIG. 7 for the PVC balls 32, the payload is nonlethal effective from 75 to 115 meters. At 75 meters the spread of the payload is 55.8 feet and at 111 meters the spread of the payload is 83.4 feet. In FIG. 8 for the fin stabilized rubber projectiles 34, the payload is nonlethal effective from 95 to 125 meters with a spread ranging from 67 feet to 89 feet.

By changing charge weights and projectile weights, the designs can be modified to tailor the performance for specified requirements. By changing subprojectile densities and size, the nonlethal effective area can be expanded.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A nonlethal canister tank round, comprising a cartridge having a combustible case and containing propellant;

a canister projectile attached to the cartridge, the canister projectile being generally cylindrical, comprising high density polyurethane foam and including a body and a cap for closing an open end of the body, the body defining a payload space therein; and a payload disposed in the payload space wherein the payload comprises an inert material comprising one of sand and rubber pellets.

2. A nonlethal canister for attachment to a tank round, comprising:

a generally cylindrical body having an open end;

a cap for closing the open end of the body;

the body and cap comprising high density polyurethane foam and defining a payload space therein; and a payload disposed in the payload space wherein, the payload comprises an inert material comprising one of sand and rubber pellets.

3. A nonlethal canister for attachment to a tank round, comprising:

a generally cylindrical body having an open end;

a cap for closing the open end of the body;

the body and cap comprising high density polyurethane foam and defining a payload space therein; and a payload disposed in the payload space wherein the payload space comprises a plurality of subpayload spaces separated by partitions and further wherein the subpayload spaces increase in size in a direction toward the cap.

4. The nonlethal canister of claim 3 wherein the payload comprises a plurality of fillable fin stabilized projectiles disposed in the subpayload spaces.

* * * * *